US011501689B2

(12) United States Patent
Jiao et al.

(10) Patent No.: US 11,501,689 B2
(45) Date of Patent: Nov. 15, 2022

(54) CONTROL METHOD AND CONTROL APPARATUS FOR BRIGHTNESS OF DISPLAY PANEL, STORAGE MEDIUM AND PROCESSOR

(71) Applicants: ANALOGIX (CHINA) SEMICONDUCTOR, INC., Beijing (CN); ANALOGIX INTERNATIONAL LLC, Wilmington, DE (US)

(72) Inventors: Xin Jiao, Beijing (CN); Ning Zhu, Beijing (CN)

(73) Assignees: ANALOGIX (CHINA) SEMICONDUCTOR, INC., Beijing (CN); ANALOGIX INTERNATIONAL LLC, Wilmington, DE (US)

( * ) Notice: Subject to any disclaimer, the term of this patent is extended or adjusted under 35 U.S.C. 154(b) by 0 days.

(21) Appl. No.: 17/294,115

(22) PCT Filed: Mar. 25, 2019

(86) PCT No.: PCT/CN2019/079548
§ 371 (c)(1),
(2) Date: May 14, 2021

(87) PCT Pub. No.: WO2020/147195
PCT Pub. Date: Jul. 23, 2020

(65) Prior Publication Data

US 2022/0020309 A1 Jan. 20, 2022

(30) Foreign Application Priority Data

Jan. 17, 2019 (CN) ..... 201910044576.0

(51) Int. Cl.
*G09G 5/00* (2006.01)
*G09G 3/20* (2006.01)

(52) U.S. Cl.
CPC ... *G09G 3/2074* (2013.01); *G09G 2320/0233* (2013.01); *G09G 2320/0276* (2013.01); *G09G 2320/0626* (2013.01)

(58) Field of Classification Search
CPC ..... G09G 3/2074; G09G 2320/0233; G09G 2320/0276; G09G 2320/0626; G09G 5/10
See application file for complete search history.

(56) References Cited

U.S. PATENT DOCUMENTS

2005/0001827 A1* 1/2005 Abe ..... G09G 3/22 345/204
2005/0280615 A1 12/2005 Cok
2008/0122873 A1 5/2008 Hong

FOREIGN PATENT DOCUMENTS

CN 1320829 A 11/2001
CN 1956032 A 5/2007
(Continued)

OTHER PUBLICATIONS

International Search Report for corresponding application PCT/CN2019/079548 filed Mar. 25, 2019; dated Sep. 18, 2019.

*Primary Examiner* — Adam R. Giesy
(74) *Attorney, Agent, or Firm* — Cantor Colburn LLP

(57) ABSTRACT

The present disclosure discloses a control method and a control apparatus for brightness of display panel, a storage medium and a processor. The method comprises: acquiring a plurality of pixel values processed by an image processor, wherein the bit width of each of the plurality of pixel values is a first preset bit width; performing data type conversion on each pixel value to obtain a plurality of pixel values of a second preset bit width, wherein the second preset bit width is greater than the first preset bit width; sending the plurality
(Continued)

of pixel values of the second preset bit width to a digital-to-analog conversion module to determine the voltage output value of each sub-pixel of a display panel, wherein the voltage output value has a first linear relationship with the screen brightness of the display panel; and adjusting the voltage output value to control the screen brightness of the display panel.

6 Claims, 1 Drawing Sheet

(56) References Cited

FOREIGN PATENT DOCUMENTS

| | | | |
|---|---|---|---|
| CN | 106328083 | A | 1/2017 |
| CN | 101123074 | A | 4/2019 |
| CN | 109637499 | A | 4/2019 |

* cited by examiner

CONTROL METHOD AND CONTROL APPARATUS FOR BRIGHTNESS OF DISPLAY PANEL, STORAGE MEDIUM AND PROCESSOR

CROSS-REFERENCE TO RELATED APPLICATION

The present disclosure claims priority to Chinese Patent Application No. 201910044576.0, filed to the Chinese Patent Office on Jan. 17, 2009 and entitled "Control Method and Control Apparatus for Brightness of Display Panel", which is incorporated herein by reference in its entirety.

TECHNICAL FIELD

The present disclosure relates to the field of display panel control, and in particular, to a control method and a control apparatus for brightness of a display panel, a storage medium and a processor.

BACKGROUND in the related art, the display panel often has uneven brightness, causing various display traces, i.e., Mura phenomenon. There are many reasons for the phenomenon, one of which is inconsistent attenuation of an input signal caused by a circuit layout process in the display panel, thereby leading to differences in display brightness. If you want to eliminate Mura, the current way is generally to adjust the display brightness by adjusting the display grayscale value to achieve the effect of uniform display brightness of the display panel. However, when the grayscale compensation voltage is adjusted in this way, the compensation voltage value is often wrong due to inaccurate calculation of the grayscale value and a large number of values. As a result, the display brightness will be uneven and the accuracy of the brightness compensation will be insufficient, so that when a user watches content displayed on the display panel, the user often experiences increased fatigue, which in turn reduces the user's interest in using the display panel.

In view of the problems above, no effective solution has been proposed.

SUMMARY

Embodiments of the present disclosure provide a control method and a control apparatus for brightness of a display panel, a storage medium and a processor so as to at least solve the technical problem that a user's interest in using a display panel will be reduced due to insufficient compensation accuracy when adjusting the grayscale compensation voltage to eliminate the uneven brightness of the display panel in the related art.

According to one aspect of the embodiments of the present disclosure, a control method for brightness of a display panel is provided, the method may include: a plurality of pixel values processed by an image processor are acquired, wherein the bit width of each of the plurality of pixel values is a first preset bit width; data type conversion on each of the pixel values is performed to obtain a plurality of pixel values of a second preset bit width, wherein the second preset bit width is greater than the first preset bit width; the plurality of pixel values of the second preset bit width are sent to a digital-to-analog conversion module to determine the voltage output value of each sub-pixel of a display panel, wherein the voltage output value has a first linear relationship with the screen brightness of the display panel; and adjusting the output voltage value to control the screen brightness of the display panel.

Optionally, the first preset bit width is greater than or equal to 8 bits, and the second preset bit width is greater than or equal to 11 bits.

Optionally, performing data type conversion on each of the pixel values to obtain a plurality of pixel values of a second preset bit width may include: data type conversion on each of the pixel values is performed by using a preset formula to obtain a plurality of pixel values of the second preset bit width, wherein the preset formula is: $DGC_{out}$=(pixel in/255)[<]BEGINITALmgamma*2047, wherein, the pixel in is a pixel value processed by the image processor, the $DGC_{out}$ is a pixel value obtained by data type conversion, and the gamma is a parameter.

Optionally, performing data type conversion on each of the pixel values to obtain a plurality of pixel values of the second preset bit width may further include: a reserved conversion range for brightness adjustment is preset, wherein the reserved conversion range is set to adjust the maximum brightness of the display panel.

Optionally, when performing data type conversion on each pixel value to obtain a plurality of pixel values of a second preset bit width, the method may further include: a second linear relationship between the plurality of pixel values of the second preset bit width and the voltage output value is determined.

According to another aspect of the embodiments of the present disclosure, a control method for brightness of a display panel is further provided. The method may include: a plurality of pixel values are received, wherein the bit width of each of the pixel values is a first preset bit width; data type conversion on each of the pixel values is performed to obtain a plurality of pixel values of a second preset bit width, wherein the second preset bit width is greater than the first preset bit width; and the voltage output value is adjusted according to the pixel values of the second preset bit width, so as to control the screen brightness of the display panel.

According to another aspect of the embodiments of the present disclosure, a control apparatus for brightness of a display panel is further provided. The apparatus may include: an image processor, configured to output a plurality of pixel values of a display panel, wherein the bit width of each of the pixel values is a first preset bit width; a digital gamma corrector, configured to perform data type conversion on the plurality of pixel values to obtain a plurality of pixel values of a second preset bit width, wherein the second preset bit width is greater than the first preset bit width; a Demura module, configured to correct the pixel values of the second preset width so as to determine the voltage output value of each sub-pixel in the display panel; and a digital-to-analog conversion module configured to adjust the voltage output value so as to control the screen brightness of the display panel.

Optionally, the first preset bit width is greater than or equal to 8 bits, and the second preset bit width is greater than or equal to 11 bits.

Optionally, the digital gamma corrector may include: a conversion module, configured to perform data type conversion on each of the pixel values by using a preset formula, so as to obtain a plurality of pixel values of the second preset bit width, wherein the preset formula is: $DGC_{out}$=(pixel in/255)[<]BEGINITALmgamma*2047, wherein, the pixel in is a pixel value processed by the image processor, the $DGC_{out}$ is a pixel value obtained by data type conversion, and the gamma is a parameter.

Optionally, the control apparatus for the brightness of the display panel may further include: a reservation module, configured to preset a reserved conversion range for brightness adjustment when performing data type conversion on each of the pixel values to obtain a plurality of pixel values of a second preset width, wherein the reserved conversion range is set to adjust the maximum brightness of the display panel.

Optionally, the control apparatus for the brightness of the display panel may further include: a determination module, configured to, when performing data type conversion on each of the pixel values to obtain a plurality of pixel values of a second preset bit width, determine a second linear relationship between the plurality of pixel values of the second preset bit width and the voltage output value.

According to another aspect of the embodiments of the present disclosure, a storage medium is further provided. The storage medium is configured to store a program, wherein when the program is executed by a processor, an apparatus in which the storage medium is located is controlled to execute any one of the described control methods for brightness of a display panel.

According to another aspect of the embodiments of the present disclosure, a processor is further provided, wherein the processor is configured to run a program, and when the program is running, any one of the described control methods for brightness of a display panel is executed.

In the embodiments of the present disclosure, acquiring a plurality of pixel values processed by an image processor, wherein the bit width of each of the plurality of pixel values is a first preset bit width, performing data type conversion on each pixel value to obtain a plurality of pixel values of a second preset bit width, wherein the second preset bit width is greater than the first preset bit width, sending the plurality of pixel values of the second preset bit width to a digital-to-analog conversion module to determine the voltage output value of each sub-pixel of the display panel, wherein, the voltage output value has a first linear relationship with the screen brightness of the display panel, and adjusting the voltage output value to control the screen brightness of the display panel. In the embodiments, by adjusting the bit width of the pixel values, the purpose of accurately determining the voltage output value can be achieved, thereby adjusting the screen brightness of the display panel, achieving the effect of improving the compensation accuracy of the screen brightness of the display panel, and further solving the technical problem that a user's interest in using a display panel will be reduced due to insufficient compensation accuracy when adjusting the grayscale compensation voltage to eliminate the uneven brightness of the display panel in the related art.

BRIEF DESCRIPTION OF THE DRAWINGS

The drawings described herein are provided for further understanding of the present disclosure and form a part of the present disclosure, and the exemplary embodiments of the present disclosure and the description thereof are provided to explain the present disclosure, rather than to limit the present disclosure. In the drawings.

DETAILED DESCRIPTION OF THE EMBODIMENTS

Figure 1:
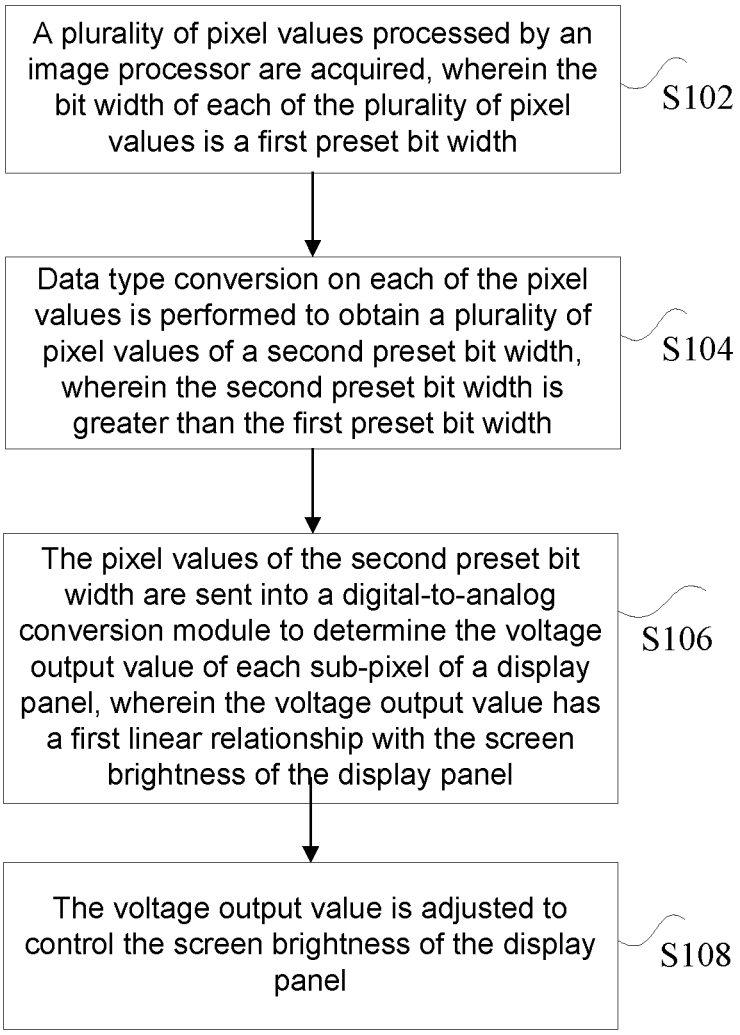
FIG. 1 is a flowchart of a control method for brightness of a display panel according to embodiments of the present disclosure.

To make a person skilled in the art better understand the solutions of the present disclosure, the following will clearly and completely describe the technical solutions in the embodiments of the present disclosure with reference to the accompanying drawings in the embodiments of the present disclosure. Obviously, the described embodiments are merely a part rather than all of the embodiments of the present disclosure. On the basis of the embodiments of the present disclosure, all other embodiments obtained by a person skilled in the art without involving any inventive effort shall belong to the scope of protection of the present disclosure.

It should be noted that, terms such as "first" and "second" in the description, claims and drawings of the present disclosure are provided to distinguish similar objects, and are not necessarily provided to describe a specific sequence or order. It should be understood that the data used in this way may be interchanged where appropriate, so that the embodiments of the present disclosure described herein can be implemented in sequences other than those illustrated or described herein. In addition, the terms "comprise" and "have", and any variations thereof, are intended to cover a non-exclusive range of inclusion, for example, a process, method, system, product, or apparatus that includes a series of steps or units is not necessarily limited to those steps or units that are expressly listed, but may include other steps or units that are not expressly listed or inherent to such a process, method, product, or apparatus.

According to some embodiments of the present disclosure, an embodiment of a control method for brightness of a display panel is provided. It should be noted that the steps shown in the flowchart of the drawings can be executed in, for example, a computer system having a set of computer executable instructions. In addition, although the logic order is shown in the flowchart, in some cases, the shown or described steps can be executed in an order different from that described herein.

To facilitate understanding of users for the present disclosure, some terms or nouns involved in the embodiments of the present disclosure are explained below:

Mura, indicating that the brightness of a display is uneven, causing various traces.

Demura, eliminating Mura of a display to make the brightness of a picture uniform; during implementation, firstly letting a panel display a grayscale picture; using various capacitive coupling devices to photograph a screen; acquiring the brightness value of each pixel point in the panel; and adjusting the grayscale value or voltage of a pixel point in a Mura region.

GPU, Graphics Processing Unit, a graphics processor, being a microprocessor dedicated to performing image computation on a terminal.

AP, Application Processor, an application processor.

Analog, an analog signal.

Pixel, a pixel.

DAC, Digital Analog Convertor, a digital-to-analog converter, configured to convert a digital signal into an analog signal and output same in the form of current, voltage or charge.

Panel, a display panel.

DGC, Digital Gamma Correction, a digital gamma corrector.

The following embodiments of the present disclosure can be applied to various display panels, the type and model of the display panel are not specifically limited, and the display panel may include, but not limited to, an LED display screen, a PC display screen, a flat panel display screen, etc., In the embodiments of the present disclosure, various defects and traces caused by uneven brightness of the display panel can be eliminated. In the traditional way of adjusting the grayscale value to compensate the voltage, the adjusted voltage accuracy is insufficient. In contrast, in the present disclosure, the screen brightness of the display panel can be adjusted by controlling the current through the voltage, and as the adjusted voltage has a linear relationship with the screen brightness, and therefore, the screen brightness of the display panel can be adjusted directly, thereby improving the accuracy of compensation, and achieving brightness uniformity adjustment. The following describes the embodiments in detail.

Embodiment 1

FIG. 1 is a flowchart of a control method for brightness of a display panel according to some embodiments of the present disclosure. As shown in FIG. 1, the method comprises the following steps:

step S102, a plurality of pixel values processed by an image processor are acquired, wherein the bit width of each of the plurality of pixel values is a first preset bit width;

step S104, data type conversion on each of the pixel values is performed to obtain a plurality of pixel values of a second preset bit width, wherein the second preset bit width is greater than the first preset bit width;

step S106, the pixel values of the second preset bit width are sent into a digital-to-analog conversion module to determine the voltage output value of each sub-pixel of a display panel, wherein the voltage output value has a first linear relationship with the screen brightness of the display panel;

step S108: the voltage output value is adjusted to control the screen brightness of the display panel.

By the steps above, a plurality of pixel values processed by the image processor are acquired, wherein, the bit width of each of the plurality of pixel values is a first preset bit width, the data type conversion is performed on each of the pixel values to obtain a plurality of pixel values of a second preset bit width, wherein the second preset bit width is greater than the first preset bit width, the pixel values of the second preset bit width are sent to the digital-to-analog conversion module, the voltage output value of each sub-pixel of the display panel is determined, wherein the voltage output value has a first linear relationship with the screen brightness of the display panel, and the output value of the voltage is adjusted so as to control the screen brightness of the display panel. In the embodiments, by adjusting the bit width of the pixel values, the purpose of accurately determining the voltage output value can be achieved, so as to adjust the screen brightness of the display panel, thereby achieving the effect of improving the compensation accuracy of the screen brightness of the display panel, and further solving the technical problem that a user's interest in using a display panel will be reduced due to insufficient compensation accuracy when adjusting the gray-scale compensation voltage to eliminate the uneven brightness of the display panel in the related art.

The steps above will be described below.

Step S102: a plurality of pixel values processed by an image processor are acquired, wherein the bit width of each of the plurality of pixel values is a first preset bit width.

As an optional example of the present disclosure, pixels obtained from a display panel may be processed by a graphics processing unit (GPU) or an application processor (AP), and pixel values corresponding to the pixels on the display panel may be output by the graphics processing unit (GPU) or the application processor (AP). Obviously, in the present disclosure, the graphics processing unit (GPU) or the application processor (AP) may also output grayscale values corresponding to the pixels on the display panel.

Optionally, the first preset bit width is greater than or equal to 8 bits. Step S104: data type conversion is performed on each of the pixel values to obtain a plurality of pixel values of a second preset bit width, wherein the second preset bit width is greater than the first preset bit width.

The second preset bit width is greater than or equal to 11 bits.

In the following embodiments, the embodiments of the present disclosure are described in detail by taking a first preset bit width of 8 bits and a second preset bit width of 11 bits as an example, including the preset formula involved in the following embodiments and the content involved in table 1. Obviously, the present disclosure may also be described in detail with other bit widths.

As an optional example of the present disclosure, performing data type conversion on each of the pixel values to obtain a plurality of pixel values of a second preset bit width comprises: performing data type conversion on each of the pixel values by using a preset formula to obtain a plurality of pixel values of the second preset bit width, wherein the preset formula is: $DGC_{out}=(\text{pixel in}/255)^{[<]BEGINITALmgamma}*2047$, wherein, the pixel in is a pixel value processed by the image processor, the $DGC_{out}$ is a pixel value obtained by data type conversion, and the gamma is a parameter.

Optionally, the gamma in the preset formula above may be 2.2. In the embodiments of the present disclosure, as the amount of gamma data is large, it can be compressed first and decompressed in real time to get the corresponding value.

By the processing of the preset formula above, the bit width of the pixel value can be improved, and then the corresponding voltage output value is determined by using a linear relationship between the second preset bit width and the voltage output value.

A mapping relationship between the pixel value calculated by the preset formula and the corresponding screen brightness value of the display panel is shown in the following table 1, and the specific table 1 is as follows:

TABLE 1

| pixel in | DGC out | screen brightness value of display panel |
|---|---|---|
| 255 | 2047 | 350 |
| 224 | 1639 | 263 |
| 192 | 1100 | 187 |
| 160 | 750 | 126 |
| 128 | 450 | 77 |
| 96 | 240 | 41 |
| 64 | 90 | 17 |
| 32 | 19 | 4 |
| 0 | 0 | 0 |

In the embodiments of the present disclosure, performing data type conversion on each pixel value to obtain a plurality of pixel values of a second preset bit width further comprises: a reserved conversion range for brightness adjustment is preset, wherein the reserved conversion range is set to adjust the maximum brightness of the display panel.

In the present disclosure, the reserved conversion range may be defined as a margin, through which the adjustment for the maximum brightness can be easily achieved, and a calculation formula of a reference brightness (log L) is ref_log L=gamma_r*log(2047/2047), wherein log(2047/2047)=0; and if there is no reserved conversion range, the maximum brightness cannot be adjusted. The adjustment for the brightness of the display panel can be extended by the reserved conversion range, that is, the adjustment is not limited to the screen display brightness corresponding to 2047.

Further optionally, when performing data type conversion on each pixel value to obtain a plurality of pixel values of a second preset bit width, the method further comprises: a second linear relationship between the plurality of pixel values of the second preset bit width and the voltage output value is determined.

That is, there will be a corresponding linear relationship between the pixel values of the second preset bit width, the voltage output value and the screen brightness of the display panel, and the screen brightness of the display panel can be directly adjusted through the linear relationship.

Step S106: the pixel values of the second preset bit width are sent to the digital-to-analog conversion module to determine the voltage output value of each sub-pixel of the display panel, wherein the voltage output value has a first linear relationship with the screen brightness of the display panel.

Step S108: the voltage output value is adjusted so as to control the screen brightness of the display panel.

Optionally, when adjusting the voltage output value, the analog current may be directly adjusted, and the brightness of each sub-pixel of the display panel may be directly adjusted.

By means of the described embodiments, after the pixel values of the display panel are obtained by the processing of the image processor, the bit width of the pixel values can be improved, and the screen brightness of the display panel can be adjusted according to an correlation between the improved pixel bit width, the voltage output value and the screen brightness of the display panel, thereby improving the accuracy of the screen brightness.

The present disclosure will be described below by way of other embodiments. The following control apparatus for the brightness of a display panel can implement the steps above.

Embodiment 2

Figure 2:
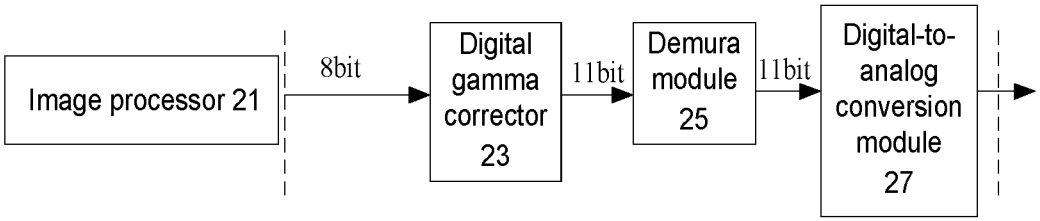
FIG. 2 is a schematic diagram of another optional control apparatus for brightness of a display panel according to embodiments of the present disclosure.

FIG. 2 is a schematic diagram of another optional control apparatus for brightness of a display panel according to the embodiments of the present disclosure. As shown in FIG. 2, the apparatus comprises: an image processor 21, a digital gamma corrector 23, a Demura module 25, and a digital-to-analog conversion module 27, wherein the image processor 21 is configured to output a plurality of pixel values of a display panel, wherein the bit width of each of the pixel values is a first preset bit width;

the digital gamma corrector 23 is configured to perform data type conversion on a plurality of pixel values to obtain a plurality of pixel values of a second preset bit width, wherein the second preset bit width is greater than the first preset bit width;

the Demura module 25 is configured to correct the pixel values of the second preset bit width so as to determine the voltage output value of each sub-pixel in the display panel; and the digital-to-analog conversion module 27 is configured to adjust the voltage output value so as to control the screen brightness of the display panel.

The control apparatus for brightness of a display panel outputs a plurality of pixel values of a display panel by using the image processor 21, wherein the bit width of each of the plurality of pixel values is a first preset bit width, performs data type conversion on a plurality of pixel values by using the digital gamma corrector 23 to obtain a plurality of pixel values of a second preset bit width, wherein the second preset bit width is greater than the first preset bit width, and corrects the pixel values of the second preset bit width by using the Demura module 25 so as to determine the voltage output value of each sub-pixel in the display panel, and adjusts the output voltage value by using the digital-to-analog conversion module 27 so as to control the screen brightness of the display panel. In the embodiments, by adjusting the bit width of the pixel values, the purpose of accurately determining the voltage output value can be achieved, so as to adjust the screen brightness of the display panel, thereby achieving the effect of improving the compensation accuracy of the screen brightness of the display panel, and further solving the technical problem that a user's interest in using a display panel will be reduced due to insufficient compensation accuracy when adjusting the gray-scale compensation voltage to eliminate the uneven brightness of the display panel in the related art.

Optionally, the first preset bit width is greater than or equal to 8 bits, and the second preset bit width is greater than or equal to 11 bits.

Optionally, the digital gamma corrector comprises: a conversion module, configured to perform data type conversion on each of the pixel values by using a preset formula, so as to obtain a plurality of pixel values of a second pre set bit width, wherein the preset formula is: $DGC_{out}$=(pixel in/255)[<]BEGINITALmgamma*2047, wherein, the pixel in is a pixel value processed by the image processor, the $DGC_{out}$ is a pixel value obtained by data type conversion, and the gamma is a parameter.

Optionally, the control apparatus for brightness of a display panel further comprises: a reservation module, configured to preset a reserved conversion range for brightness adjustment when performing data type conversion on each of the pixel values to obtain a plurality of pixel values of a second preset width, wherein the reserved conversion range is set to adjust the maximum brightness of the display panel.

Optionally, the control apparatus for brightness of a display panel further comprises: a determination module, configured to, when performing data type conversion on each of the pixel values to obtain a plurality of pixel values of a second preset bit width, determine a second linear relationship between the plurality of pixel values of the second preset bit width and the voltage output value.

According to another aspect of the embodiments of the present disclosure, a storage medium is further provided. The storage medium is configured to store a program, when the program is executed by a processor, an apparatus in which the storage medium is located is controlled to execute any one of the described control methods for brightness of a display panel.

According to another aspect of the embodiments of the present disclosure, a processor is further provided. The processor is configured to run a program, wherein when the program is running, any one of the described control methods for brightness of a display panel is executed.

The described control apparatus for brightness of a display panel may also comprise a processor and a memory.

The image processor 21, digital gamma corrector 23, Demura module 25, digital-to-analog conversion module 27 above, etc. are all stored in the memory as program units, and the processor executes the described program units stored in the memory to realize corresponding functions.

The processor above includes a kernel, which calls a corresponding program unit from the memory. There may be one or more kernels, and the voltage output value is adjusted by adjusting the kernel parameter, so as to control the screen brightness of the display panel.

The memory above may include a computer readable medium in the form of a non-permanent memory, a random access memory (RAM), and/or a memory, such as a read-only memory (ROM) or a flash RAM, and the memory includes at least one memory chip.

The embodiments of the present disclosure provide an apparatus. The apparatus comprises a processor, a memory and a program which is stored in the memory and can run on the processor. When the program is executed by the processor, the following steps are realized: a plurality of pixel values processed by an image processor are acquired, wherein the bit width of each of the plurality of pixel values is a first preset bit width; data type conversion on each of the pixel values is performed to obtain a plurality of pixel values of a second preset bit width, wherein the second preset bit width is greater than the first preset bit width; the pixel values of the second preset bit width are sent to a digital-to-analog conversion module to determine the voltage output value of each sub-pixel of a display panel, wherein the voltage output value has a first linear relationship with the screen brightness of the display panel; and the voltage output value is adjusted so as to control the screen brightness of the display panel.

Optionally, the first preset bit width is greater than or equal to 8 bits, and the second preset bit width is greater than or equal to 11 bits.

Optionally, when the program is executed by the processor, the following step may further be realized: data type conversion is performed on each pixel value by a preset formula to obtain a plurality of pixel values of a second pre set bit width, wherein the preset formula is:

$DGC_{out}$=(pixel in/255)[<]BEGINITALmgamma*2047, wherein the pixel in is a pixel value processed by the image processor, the DGC out is a pixel value obtained by data type conversion, and the gamma is a parameter.

Optionally, when the program is executed by the processor, the following step may further be realized: when performing data type conversion on each of the pixel values to obtain a plurality of pixel values of a second preset bit width, a reserved conversion range for brightness adjustment is preset, wherein the reserved conversion range is set to adjust the maximum brightness of the display panel.

Optionally, when the program is executed by the processor, the following step may further be realized: when performing data type conversion on each of the pixel values to obtain a plurality of pixel values of a second preset bit width, a second linear relationship between the plurality of pixel values of the second preset bit width and the voltage output value is determined.

The present disclosure further provides a computer program product. The computer program product, when being executed on a data processing device, is suitable for executing a program initialized with the following method steps: acquiring a plurality of pixel values processed by an image processor, wherein the bit width of each of the pixel values is a first preset bit width; performing data type conversion on each pixel value to obtain a plurality of pixel values of a second preset bit width, wherein the second preset bit width is greater than the first preset bit width; sending the plurality of pixel values of the second preset bit width to a digital-to-analog conversion module to determine the voltage output value of each sub-pixel of a display panel, wherein the voltage output value has a first linear relationship with the screen brightness of the display panel; and adjusting the voltage output value so as to control the screen brightness of the display panel.

The sequence numbers of the embodiments of the present disclosure are only for description, and do not represent the preference of the embodiments.

In the described embodiments of the present disclosure, descriptions of the embodiments are focused on different parts, and for a part that is not described in detail in a certain embodiment, reference may be made to related descriptions of other embodiments.

In the embodiments provided in the present disclosure, it should be understood that the disclosed technical content may be implemented in other manners. The apparatus embodiments described above are merely exemplary, for example, the division of the units may be logical function division, and may be other division in actual implementation, and for example, a plurality of units or components may be combined or integrated into another system, or some features may be ignored or not executed. In addition, the displayed or discussed mutual couplings or direct couplings or communication connections may be implemented through some interfaces, and the indirect couplings or communication connections between units or modules may be implemented in electrical or other forms.

The units described as separate parts may or may not be physically separate, and parts displayed as units may or may not be physical units, may be located in one position, or may be distributed on a plurality of units. Some or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit. The integrated unit may be implemented in the form of hardware, and may also be implemented in the form of a software functional unit.

If the integrated unit is implemented in the form of a software functional unit and sold or used as an independent product, the integrated unit may be stored in a computer readable storage medium. Based on such understanding, the technical solutions of the present disclosure essentially, or the part contributing to the prior art, or all or some the technical solutions may be implemented in the form of a software product. The computer software product is stored in a storage medium, and comprises several instructions for instructing a computer device (which may be a personal computer, a server, a network device, or the like) to perform all or some of the steps of the methods described in the embodiments of the present disclosure. The foregoing storage medium includes: any medium that can store program codes, such as a USB flash disk, a read-only memory (ROM, Read-Only Memory), a random access memory (RAM, Random Access Memory), a removable hard disk, a magnetic disk, or an optical disk.

The embodiments described above are only preferred embodiments of the present disclosure. It should be noted that, a person of ordinary skill in the art may make further improvements and modifications without departing from the principle of the present disclosure, and these improvements and modifications shall also belong to the scope of protection of the present disclosure.

INDUSTRIAL APPLICABILITY

The solutions provided by the embodiments of the present disclosure can be used to adjust the screen brightness of the display panel in real time. In the technical solutions provided in the embodiments of the present disclosure, the present disclosure can be applied to a touch display device such as a display panel (e.g., OLED) or a touch screen. When the display panel is actually operating, the screen brightness of the display panel can be adjusted in real time. By adjusting the bit width of the pixel values, the purpose of accurately determining the voltage output value is achieved, and therefore, thereby adjusting the screen brightness of the display panel, achieving the effect of improving the compensation accuracy of the screen brightness of the display panel, and solving the technical problem that a user's interest in using a display panel will be reduced due to insufficient compensation accuracy when adjusting the grayscale compensation voltage to eliminate the uneven brightness of the display panel in the related art. In the embodiments of the present disclosure, type conversion may be directly performed on each pixel value, and then the pixel value with a high bit width is output, thereby determining the voltage output value of each module of each display panel.

What is claimed is:

1. A control method for brightness of a display panel, comprising:

acquiring a plurality of pixel values processed by an image processor, wherein the bit width of each of the plurality of pixel values is a first preset bit width;

performing data type conversion on each of the pixel values to obtain a plurality of pixel values of a second preset bit width, wherein the second preset bit width is greater than the first preset bit width;

sending the plurality of pixel values of the second preset bit width to a digital-to-analog conversion module to determine a voltage output value of each sub-pixel of the display panel, wherein the voltage output value has a first linear relationship with the screen brightness of the display panel; and adjusting the output voltage value to control the screen brightness of the display panel wherein when performing data type conversion on each of pixel values to obtain a plurality of pixel values of the second preset bit width, the method further comprises: determining a second linear relationship between the plurality of pixel values of the second preset bit width and the voltage output value.

2. The control method as claimed in claim 1, wherein the first preset bit width is greater than or equal to 8 bits, and the second preset bit width is greater than or equal to 11 bits.

3. The control method as claimed in claim 1, wherein performing data type conversion on each of the pixel values to obtain a plurality of pixel values of the second preset bit width comprises:

performing data type conversion on each of the pixel values by using a preset formula to obtain a plurality of pixel values of the second preset bit width, wherein the preset formula is:

$$DGC_{out}=(\text{pixel in}/255)^{[<]\text{BEGINITALmgamma}}*2047,$$

wherein, the pixel in is a pixel value processed by the image processor, the $DGC_{out}$ is a pixel value obtained by data type conversion, and the gamma is a parameter.

4. The control method as claimed in claim 1, wherein when performing data type conversion on each of the pixel values to obtain a plurality of pixel values of the second preset bit width, the method further comprises:

presetting a reserved conversion range for brightness adjustment, wherein the reserved conversion range is set to adjust the maximum brightness of the display panel.

5. A non-transitory storage medium, wherein the storage medium is configured to store a program, wherein when the program is executed by a processor, an apparatus in which the storage medium is located is controlled to execute the control method for brightness of a display panel in claim 1.

6. A control method for brightness of a display panel, comprising:

receiving a plurality of pixel values, wherein the bit width of each of the pixel values is a first preset bit width;

performing data type conversion on each of the pixel values to obtain a plurality of pixel values of a second preset bit width, wherein the second preset bit width is greater than the first preset bit width; and adjusting a voltage output value according to the pixel values of the second preset bit width, so as to control screen brightness of the display panel;

wherein when performing data type conversion on each of pixel values to obtain a plurality of pixel values of the second preset bit width, the method further comprises: determining a second linear relationship between the plurality of pixel values of the second preset bit width and the voltage output value.

* * * * *